United States Patent [19]

Munro

[11] Patent Number: 4,541,240

[45] Date of Patent: Sep. 17, 1985

[54] EXHAUST SYSTEM FOR INTERNAL COMBUSTION ENGINES

[76] Inventor: John H. Munro, 10 Wood St., Southwick, Mass. 01077

[21] Appl. No.: 493,930

[22] Filed: May 12, 1983

Related U.S. Application Data

[62] Division of Ser. No. 171,654, Jul. 23, 1980, Pat. No. 4,393,652.

[51] Int. Cl.[3] ..... F01N 3/02; F01N 1/24; F01N 3/20

[52] U.S. Cl. ..... 60/295; 55/276; 55/DIG. 30; 60/297; 60/309; 60/311; 181/243; 181/249; 181/252; 181/264; 181/281; 422/176

[58] Field of Search ..... 60/295, 297, 299, 309, 60/311; 422/176; 181/243, 249, 252, 256, 264, 280, 281; 55/276, DIG. 30

[56] References Cited

U.S. PATENT DOCUMENTS

| | | | |
|---|---|---|---|
| 1,522,111 | 1/1925 | Franck | 60/299 |
| 2,673,446 | 3/1954 | Salardi | 60/297 |
| 3,061,416 | 10/1962 | Kazokas | 60/297 |
| 3,154,389 | 10/1964 | Hayes | 60/297 |
| 3,177,650 | 4/1965 | Caruso | 60/311 |
| 3,282,046 | 11/1966 | Walker | 60/297 |
| 3,421,315 | 1/1969 | Aoi | 60/297 |
| 3,476,524 | 11/1969 | Burke | 422/173 |
| 3,556,735 | 1/1971 | Epelman | 60/295 |
| 3,563,338 | 2/1971 | Rader | 181/243 |
| 3,860,403 | 1/1975 | Aoi | 60/311 |
| 4,032,310 | 6/1977 | Ignoffo | 60/295 |
| 4,054,418 | 10/1977 | Miller | 60/297 |

FOREIGN PATENT DOCUMENTS

| | | | |
|---|---|---|---|
| 2142566 | 3/1973 | Fed. Rep. of Germany | 60/295 |
| 2304362 | 8/1974 | Fed. Rep. of Germany | 60/299 |
| 716684 | 10/1931 | France | 181/281 |
| 1318749 | 1/1963 | France | 60/297 |
| 504653 | 12/1954 | Italy | 181/252 |
| 557740 | 2/1957 | Italy | 181/281 |

*Primary Examiner*—Douglas Hart
*Attorney, Agent, or Firm*—Edward A. Gordon

[57] ABSTRACT

The present invention provides an exhaust system comprising an elongated hollow casing having an upstream muffler chamber containing an insulated removable cartridge for sound absorbing and sound collecting, an intermediate chamber containing a removable spark and moisture arrester and a downstream chamber having a removable and replaceable cartridge containing exhaust gas purifying material. In one embodiment the cartridge provides dual chambers, one for absorbing and absorbing exhaust gas pollutants and the other for catalytic conversion of the same or different exhaust gases. The purifying cartridge is constructed of a foraminous material such as heat and corrosion resistant wire mesh or screen. Similarly, the muffler cartridge is an elongated hollow shell formed of a foraminous heat and corrosion resistant material such as wire mesh or screen. The annular space around the muffler cartridge is preferably filled with a heat-resistant, sound-absorbing, gas previous material. The purifier chamber is provided with guide vanes to direct the exhaust gases over the purifier material and through and out of the purifying chamber. In another embodiment the muffler cartridge is provided with a plurality of sound attenuating chambers.

3 Claims, 8 Drawing Figures

EXHAUST SYSTEM FOR INTERNAL COMBUSTION ENGINES

This is a division of application Ser. No. 171,654, filed July 23, 1980.

FIELD OF THE INVENTION

This invention relates to internal combustion engine exhaust systems and more particularly to a muffler, spark and moisture arrester and gas purifier system for internal combustion engines of motor vehicles and the like.

BACKGROUND OF THE INVENTION

The private passenger automobile and trucks constitute a major, if not the major, factor in atmospheric pollution. The exhaust gases thereof introduce into the atmosphere not only carbon monoxide but also a large number of other pollutants which adversely affect human life and plant life. Among these other pollutants may be listed nitrogen oxide gases, unburned or partially burned hydrocarbon vapors, both aromatic and alaphatic, sulfur dioxide and sulfur trioxide, and lead compounds. The major components of burned gasoline, diesel fuel and the like are carbon dioxide and water, neither of which is harmful to human or plant life. There is a great need at the present time for an effective and economical purifying means for automotive exhaust systems, because of the acute worldwide air pollution control effort. A number of different approaches to solving the problem of air pollution due to automotive exhaust constituents have been offered. Some of these proposals involve improved combustion within the engine and/or improved carburation. Others involve recycling or reburning of exhaust products before final emission into the atmosphere. Still others broadly similar to this invention propose direct placement in the exhaust conduit of a device for removing at least the more dangerous pollutants. In order for such a device to be successful and practical, it must be economical to manufacture and install without adding greatly to the total cost of the automobile or altering the otherwise conventional parts of the exhaust system, and the device must not adversely effect engine performance. To be successful, the device must also be easy and economical to maintain after installation. Prior art devices of this general character have failed to measure up fully to the above requirements and as yet no completely satisfactory exhaust purifier unit or muffler has been devised.

It is therefore a desired object of the invention to provide an internal combustion engine exhaust system that meets all the above needs and requirements.

BRIEF SUMMARY OF THE INVENTION

The present invention provides an exhaust system comprising an elongated hollow casing having an upstream muffler chamber containing an insulated removable cartridge for sound absorbing and sound collecting, an intermediate chamber containing a removable spark and moisture arrester and a downstream chamber having a removable and replaceable cartridge containing exhaust gas purifying material. In one embodiment the cartridge provides dual chambers, one for adsorbing and absorbing exhaust gas pollutants and the other for catalytic conversion of the same or different exhaust gases. The purifying cartridge is constructed of foraminuous material such as heat and corrosion resistant wire mesh or screen. Similarly, the muffler cartridge is an elongated hollow shell formed of a foraminous heat and corrosion resistant material such as wire mesh or screen. The annular space around the muffler cartridge is preferably filled with a heat-resistant, sound-absorbing, gas previous material. The purifier chamber is provided with guide vanes to direct the exhaust gases over the purifier material and through and out of the purifying chamber. In another embodiment the muffler cartridge is provided with a plurality of sound attenuating chambers.

BRIEF DESCRIPTION OF THE DRAWING

For a fuller understanding of the nature and desired objects of the invention, reference should be had to the following detailed description taken in connection with the accompanying drawing wherein like reference characters refer to corresponding parts throughout the several views and wherein.

DETAILED DESCRIPTION

Figure 1:
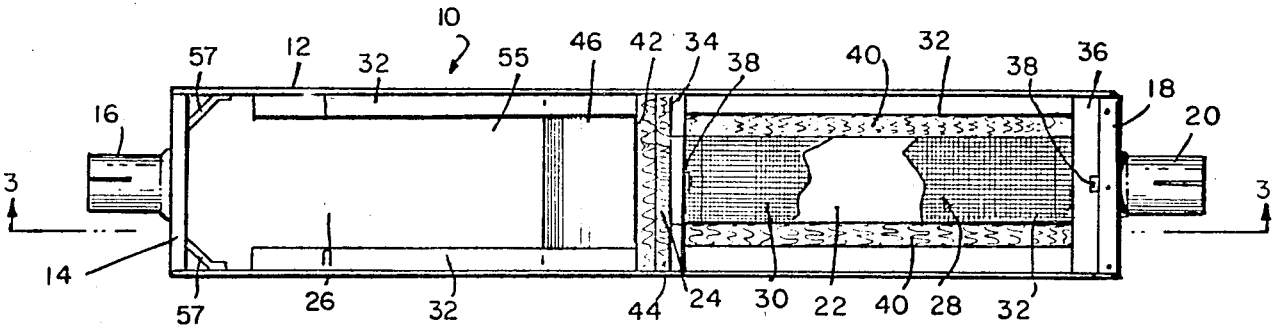
FIG. 1 is a top plan view of a muffler and exhaust gas purifier constructed in accordance with the present invention with the top cover and top insulation removed.
Figure 2:
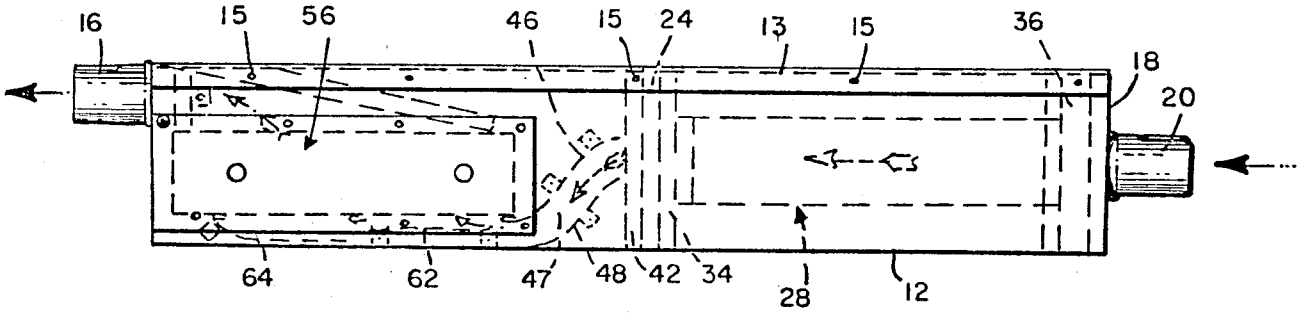
FIG. 2 is a side plan view of the muffler and exhaust gas purifier of FIG. 1.

Referring to the drawings and initially particularly to FIGS. 1-4, the muffler and exhaust gas purifier unit in accordance with the present invention is shown generally by numeral 10 and includes a casing 12 and removable cover 13 forming an elongated structure having a substantially square cross-section and constructed of metals or alloys such as stainless steel or the like which are heat and corrosion resistant. The cover may be attached by means such as metal screws 15. The casing 10 is provided with stiffening flanges 32. The downstream end is provided with an exhaust end plate 14 and a short exhaust connection 16 to be directly coupled to the exhaust tailpipe in the conventional manner. The upstream end is also provided with an intake end plate 18 and an intake connection 20 which may be coupled to the usual vehicle exhaust pipe, not shown, leading from the engine. Within the casing 12 of the exhaust gas muffler and purifier unit 10 there is provided an upstream muffler chamber 22, and intermediate, spark and moisture arrester chamber 24, and a downstream gas purifier chamber 26.

The upstream muffler chamber 22 is provided with an axially mounted removable cartridge 28. In the illustrated embodiment, the cartridge 28 comprimises a metallic foraminous shell 30 formed of metals or alloys such as stainless steel or the like which resist heat and corrosion. In the illustrated embodiment, the material comprises stainless steel wire mesh. A suitable wire mesh is preferably between 16×16 to 4×4 mesh size. The cartridge 28 is attached to and held in axial position to intake connection 20 by annular flange end plates 34 and 36 and metal screws 38. The space between the muffler cartridge 28 and casing 12 and cover 13 of the chamber 22 is packed withsound-absorbing and attenuating, heat-resistant, gas previous material 40 such as packing of heat-resistant fibers such as glass fibers.

Positioned intermediate the muffler chamber 22 and the gas purifier chamber 26 is the spark and moisture arrester chamber 24. In the embodiment illustrated chamber 24 is defined upstream by the annular flange end plate 34 and associated cartridge 28 and on the downstream side by baffle means 42 containing opening 50. The chamber 24 is filled with a replaceable heat-resistant material 44 which allows the passage of exhaust gases without great resistance while substantially effectively filtering out glowing particles and moisture. One suitable material is continuous strand stainless steel having a fine strand width.

The downstream gas purifier chamber 26 contains an upper turning vane 46 and a lower turning vane 48. The upstream ends of the upper and lower vanes are mounted respectively above and below the opening 50 in baffle means 42. Both vanes are curved downwardly with the downstream end of lower vane 48 terminating adjacent to the bottom of casing 12 at point 52 and the downstream end of upper vane 46 being secured to the support 54 for supporting purifier container 56. The upper and lower turning vanes 46 and 48 extend transversely of the longitudinal axis of the muffler 10 to the sides of the casing 12 (as shown by the upper vane 46 in FIG. 1) and are secured in position by means 58 which may suitably be pop rivets. The turning vanes 46 and 48 define a passageway 60 and serve to deflect the gases exhausting from opening 50 downwardly and then upwardly for introduction into and diffusion through and out of purifier container 56. Positioned in passage way 60 are splitter vanes 62 and 64.

Figure 3:
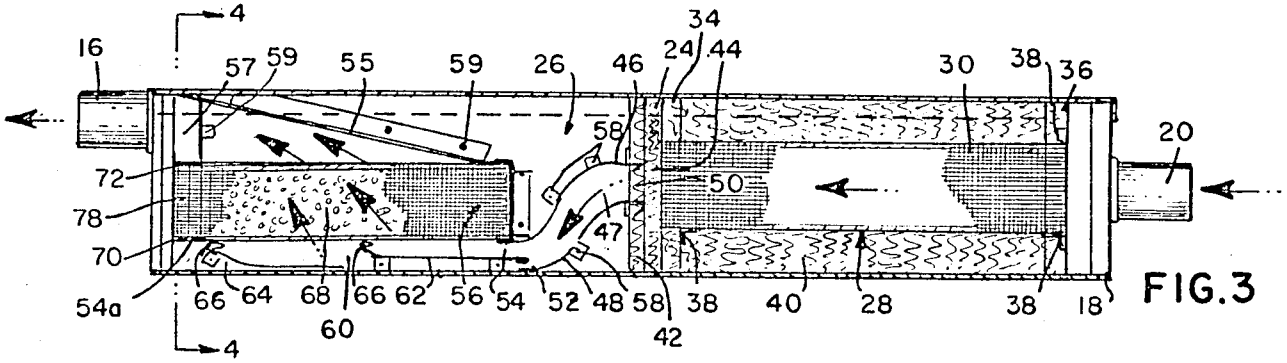
FIG. 3 is partly a side plan view and partly a vertical cross sectional view along the line 3—3 of FIG. 1.

The splitter vanes are provided with curved edges 66 to further cooperate with chamber 24 to intercept and remove moisture. As can be seen in FIG. 3 the downstream end of splitter vanes 62 and 64 terminate in curved ends or edges 66 adjacent the gas purifier chamber 56. The curved ends are inturned upwardly and back against the direction of exhaust gas flow or towards the upstream end to intercept and remove moisture from exhaust gases. It is well known to persons having ordinary skill in the pertinent art, that the major components of exhaust gases of internal combustion engines employing gasoline, diesel fuel and the like are carbon dioxide and water (see U.S. Pat. No. 4,032,310 of June 28, 1977 to Ignoffo). It is also well known to persons skilled in the art that when an internal combustion engine is shut off and cools down, water vapor in the cylinders and muffler forms moisture condensate. It is also well known that when an engine is first started such moisture condensate is blown from the cylinders into the muffler, a portion of which may be blown out the exhaust end of the muffler. It is also well known to those skilled in the art that as the engine is run, the exhaust system heats up whereby the condensate moisture is vaporized by the heat of the exhaust system and exits with the exhaust gases. In the instant invention, when the engine is first started, the curved inturned ends of the splitter vanes intercepts the condensate moisture reaching that point. The intercepted moisture then either remains on the splitter vanes and/or the base of the muffler until vaporized by the heat muffler and exhaust gases and removed along with the exhaust gases. The splitter vanes also serve to split the exhaust gases and provide for distribution of the exhaust gases over the lower surface, of purifier container 56. The arrangement allows for maximum contact of the exhaust gases with the purifying material 68 and minimizes concentration of exhaust gases about the downstream side of the container 56. In this matter, more efficient purification is achieved by the effective utilization of all the purifying material 68.

Figure 5:
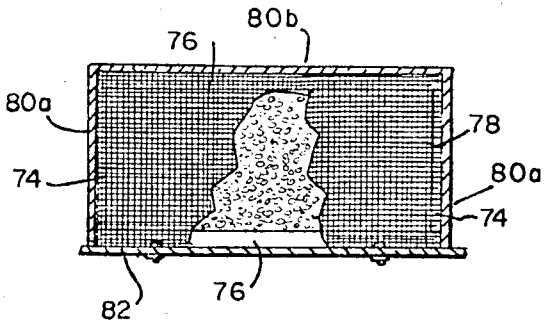
FIG. 5 is a top plan view partly broken away of the exhaust gas purifier container of FIG. 1.
Figure 4:
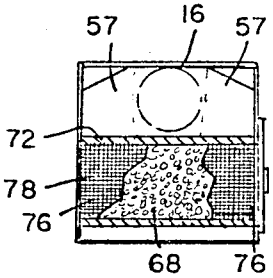
FIG. 4 is a transverse section along the line 4—4 of FIG. 3.

The gas purifier chamber 26 receives a removable purifier container 56 (FIGS. 3–5), filled with a heat-stable material 68 comprising particles of a substance or subtances which absorb and/or chemically modify the components of the exhaust gas, particularly one or more of the noxious components described hereinbefore. The removable purifier container cartridge 56 illustrated is boxshaped and has at least a foraminous gas-permeable bottom 70 and top 72, and preferably also has similarly foraminous side walls 74 and end walls 76. In the illustrated embodiment, the purifier container cartridge 56 is formed of a heat-resistant gas permeable mesh material 78 which resists corrosion such as stainless steel mesh. In the embodiment illustrated in FIGS. 3–5, the mesh material forms the bottom 70, top 72, sidewalls 74 and end wall 76. The cartridge 56 is carried by support members 80*a, b, c,* and end cover 82. The purifying material 68 as illustrated is preferably a particulate material and may consist of one or more solid, heat-resistant chemical compositions, e.g., small particles of charcoal which per se have gas-adsorbent and gas-absorbent properties and also, particularly when heated by exhaust gases, enhance further combustion of the exhaust gases, i.e., oxidation of the carbon monoxide to carbon dioxide, further combustion partially burned hydrocarbons, etc. Other substances may be catalytic support with an oxidation-promoting catalytic metal or metal compound on the support. Exemplary of such type catalytic substances are supported platinum, palladium and vanadium catalysts heretofore recommended for automotive exhaust systems. Exhaust gases exiting from the top of the purifier container 56 are directed through the exhaust connection 16 by upper guide vane 55 and side guide vanes 57. The guide vanes may be secured to the casing 12 by suitable means such as, for example, spot welds 59.

Figure 6:
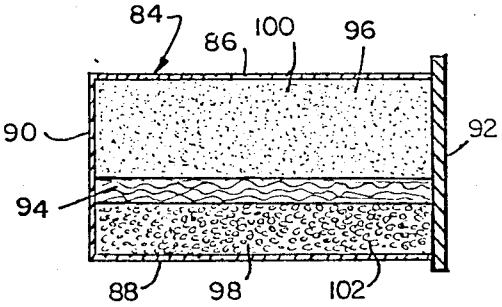
FIG. 6 is a sectional view of a modified form of the removable exhaust gas purifier container box in accordance with the invention.

Referring now to FIG. 6 there is illustrated a modified form of the removable exhaust gas purifier container box in accordance with the present invention. As illustrated, the purifier container 84 comprimises a top 86, bottom 88, end 90, and end cover 92 constructed in the same manner and with the same materials as purifier container 56. In the modified container 84 there is provided a porous member 94 which divides the container into an upper chamber 96 and a lower chamber 98. In this manner the dual chambers, upper and lower, enable the use of one chamber for holding a material for catalytic conversion of exhaust gas pollutants to non-noxious or less noxious gases. For example, upper chamber 96 may be provided with a particulate catalytic converter material 100 and lower chamber 98 provided with a particulate gas absorbing and/or adsorbing material 102. Suitable materials may, for example, be those discussed hereinbefore with respect to purifier materials.

Figure 7:
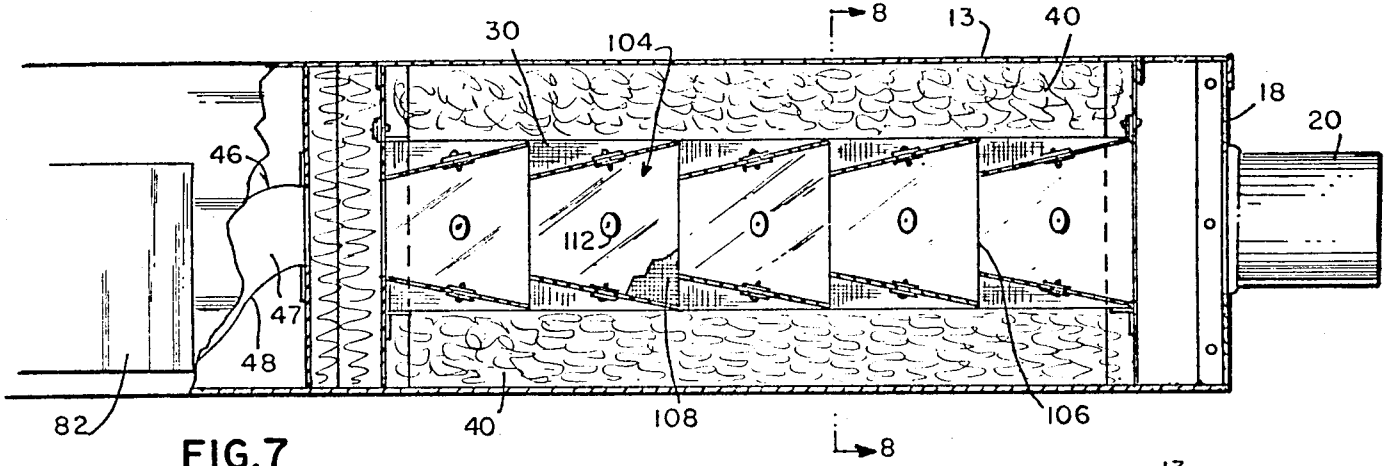
FIG. 7 is a fragmentary partially sectional view of modified form of the muffler in accordance with the invention and illustrating a modified embodiment of the muffler section.
Figure 8:
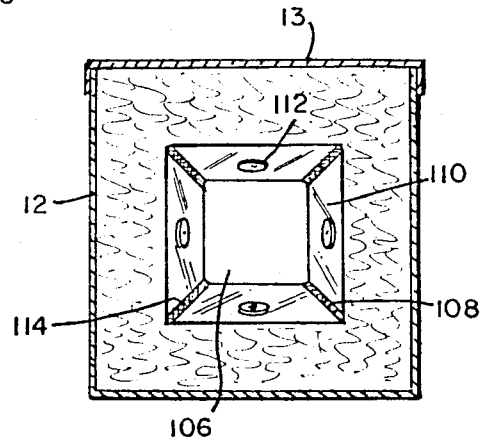
FIG. 8 is a transverse section along the line 8—8 of FIG. 7.

Referring now to FIGS. 7 and 8, there is illustrated a modified form of the muffler cartridge and comprises a plurality of sounds attenuating chambers 104 contained within the metallic foraminous shell 30. Each chamber comprises sound muffling walls which decrease in size from the upstream end to the downstream end and have axially aligned openings 106 for exhaust gases to pass through. The chambers are formed of a heat and corrosion resistant support 108 such as stainless steel wire and plates 110 which are attached to the outer surfaces of the support 108 by means 112 such as pop rivets or staples. The plates 110 are preferably formed of a heat and corrosion resistant material such as mica or other similar materials. The entire cartridge 30 is surrounded by insulation 40. The space 114 between adjacent plates 110 expose the wire supporting structure 108 which provides for further attenuation of sound by the surrounding insulation 40. It is believed that sound attenuation by the chambers is accomplished in part by diffraction of sound waves by plates 110 and reflection onto and absorbtion by the sound absorbing insulation 40.

The respective embodiments of the invention thus provide internal combustion engines with a muffler, spark and moisture arrester and exhaust gas purifier units, each having a segmented chamber providing a removable upstream sound absorbing and sound collecting cartridge means, an intermediate chamber providing a spark and moisture arrester means, and downstream chamber having removable exhaust gas purifier cartridge means. In each instance the embodiments provide a muffler and gas purifier unit which is readily adapted to and readily installed in automotive exhaust systems, provides easy access to the chambers for inspection and/or replacing the insulation, muffler cartridge, and spark and moisture arrester material. The purifier cartridge may separately easily be removed for inspection and/or replacement. Additionally, the exhaust system of the present invention may be employed with both leaded and unleaded gas.

While the invention has been described with respect to preferred embodiments, it will be apparent to those skilled in the art that changes and modifications may be made without departing from the scope of the invention herein involved in its broader aspects. Accordingly, it is intended that all matter contained in the above description, or shown in the accompanying drawing shall be interpreted as illustrated and not in limiting sense.

What is claimed is:

1. An exhaust system for connection to exhaust gas pipes of an internal combustion engine comprising a casing adapted for flow therethrough of exhaust gases from an upstream end to a downstream end of said casing, said casing having a muffler chamber at its upstream end, an intermediate spark and moisture arrester chamber and an exhaust gas purifier chamber at its downstream end, said muffler chamber comprising a removable foraminous cartridge having an axial opening therein for flow of exhaust gases therethrough and a sound attenuating material disposed about said cartridge, said removable foraminous cartridge containing a plurality of sound attenuating chambers decreasing in size from the upstream end to the downstream end and having openings for passage of sound waves from said chambers to said sound attenuating material, said intermediate chamber being filled with a heat and corrosion resistant strand material presenting a large number of surfaces serving to filtering out sparks and moisture and further muffling exhaust gases passing therethrough, said exhaust gas purifier chamber comprising a replaceable foraminous cartridge, said foraminous cartridge having a gas permeable partition dividing said cartridge into an upper chamber and a lower chamber, a particulate exhaust gas purifying material disposed in each said chambers, and means for removably supporting said foraminous cartridge within said gas purifier chamber whereby exhaust gases pass upwardly therethrough and whereby said foraminous cartridge may be withdrawn from said chamber for inspection or replacement of said foraminous cartridge.

2. The exhaust system of claim 1 wherein the particulate gas purifying material disposed in said lower chamber is a gas-absorbent or gas adsorbent material.

3. The exhaust system of claim 1, wherein the particulated gas purifying material disposed in said upper chamber is an oxidation promoting catalytic material.

* * * * *